United States Patent [19]

Weber et al.

[11] Patent Number: 4,785,679

[45] Date of Patent: Nov. 22, 1988

[54] STARTER MOTOR PINION ASSEMBLY

[75] Inventors: John H. Weber, Victoria; Larry W. Schmidt, Farmington, both of Minn.

[73] Assignee: The Toro Company, Minneapolis, Minn.

[21] Appl. No.: 92,971

[22] Filed: Sep. 3, 1987

[51] Int. Cl.[4] ..... F02N 11/14

[52] U.S. Cl. ..... 74/7 R; 74/DIG. 10

[58] Field of Search ..... 74/6, 7 R, DIG. 10, 74/434, 439, 446; 310/43, 99

[56] References Cited

U.S. PATENT DOCUMENTS

| | | | |
|---|---|---|---|
| 3,024,780 | 3/1962 | Hamman | 123/185 |
| 3,906,921 | 9/1975 | Tillotson et al. | 123/179 K |
| 3,942,505 | 3/1976 | Tillotson | 123/179 K |
| 4,694,594 | 9/1987 | Thorud et al. | 37/244 |
| 4,712,451 | 12/1987 | Morishita et al. | 74/801 |

*Primary Examiner*—Lawrence Staab
*Assistant Examiner*—Scott Anchell
*Attorney, Agent, or Firm*—James W. Miller

[57] ABSTRACT

A pinion assembly (30) for an electrical starter motor (20) includes a metallic pinion nut (4) threadedly received on an output shaft (22) of motor (20). A first bushing (36) includes a radially extending annular flange (40) which is fixed to and covers nut (4) and a cylindrical axially extending shell (42). A metallic drive pinion (32) is supported on shell (42) and is electrically insulated from shaft (20) by shell (42) and from nut (4) by annular flange (40). However, slip clutch (14) is located between first bushing (36) and drive pinion (32) to transmit torque therebetween. Finally, cylindrical member (62) retains drive pinion (32) on bushing (36).

8 Claims, 1 Drawing Sheet

STARTER MOTOR PINION ASSEMBLY

TECHNICAL FIELD

This invention relates to an electrical starter motor for starting an internal combustion engine. More particularly, this invention relates to an improved pinion assembly for such a motor having both durability and electrical insulating properties.

BACKGROUND OF THE INVENTION

Electrical starter motors are well known for starting internal combustion engines in automobiles and many other devices. The motors include an output shaft which is rotated when the electrical motor is energized. The end of the output shaft carries a drive pinion which engages and rotates a starter gear on the internal combustion engine to start the engine. The drive pinion is then disengaged from the starter gear on the engine when the engine is running.

Some devices which include electrical starter motors are operated in environments where double insulation is required or preferred to prevent the possibility of an electrical shock being given the operator. One such device of which Applicants are aware is a snowthrower having an internal combustion engine. Such snowthrowers are often sold with an electric starter motor attached thereto. The motor typically has a power cord which is plugged into an electrical socket whenever it is desired to start the snowthrower. A button is then pushed by the operator to energize the starter motor using the line voltage (110 V) contained in the socket.

The starter motors used on the snowthrowers with which Applicants are familiar have typically used a drive pinion made from plastic. This was necessary to provide the second level of insulation needed in double insulated starter motors, the first layer of insulation having been provided by the insulated windings of the motor itself. However, one disadvantage of plastic starter motor pinions is that they wear out quite quickly. This then requires that the pinion be replaced which is obviously undesirable.

SUMMARY OF THE INVENTION

One aspect of this invention is to provide an improved pinion assembly for electrical starter motors having an axially extending metallic output shaft. A pinion assembly according to this invention comprises a metallic nut threadedly received on a portion of the output shaft for axial movement along the shaft. A first plastic bushing is fixed to the nut for movement therewith. The bushing includes a cylindrical shell which extends axially along the output shaft and a radially extending annular flange in which covers the pinion nut. A metallic drive pinion is supported on an outside diameter of the shell so that the drive pinion is separated from the output shaft by the shell and from the nut by the annular flange to electrically insulate the drive pinion. A rubber clutch ring is received between one face of the annular flange of the bushing and an annular face of the drive pinion to transmit torque therebetween. Finally, a means is provided for retaining the drive pinion on the shell of the bushing during operation of the pinion assembly.

BRIEF DESCRIPTION OF THE DRAWINGS

The present invention will be described more fully hereafter in the following Detailed Description, with reference to the following drawings, wherein like numerals will refer to like elements throughout.

DETAILED DESCRIPTION

Figure 1:
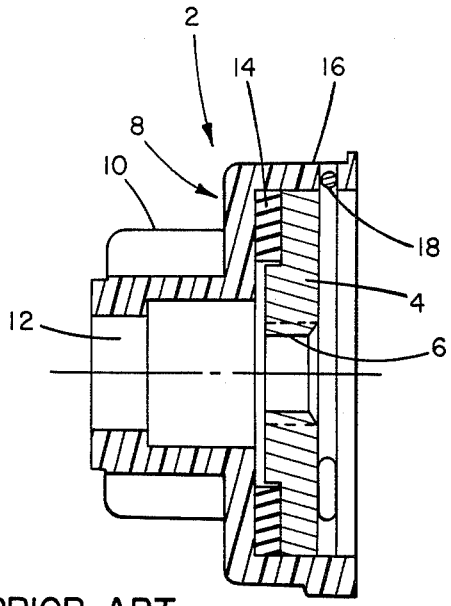
PRIOR ART FIG. 1
FIG. 1 is a cross-sectional view of a pinion assembly for a starter motor of the type known in the prior art.
Figure 2:
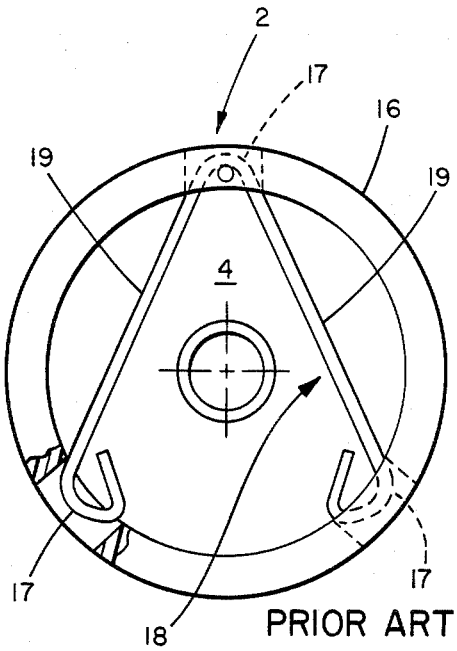
PRIOR ART FIG. 2
FIG. 2 is a partial plan view of the prior art pinion assembly shown in FIG. 1.
Figure 3:
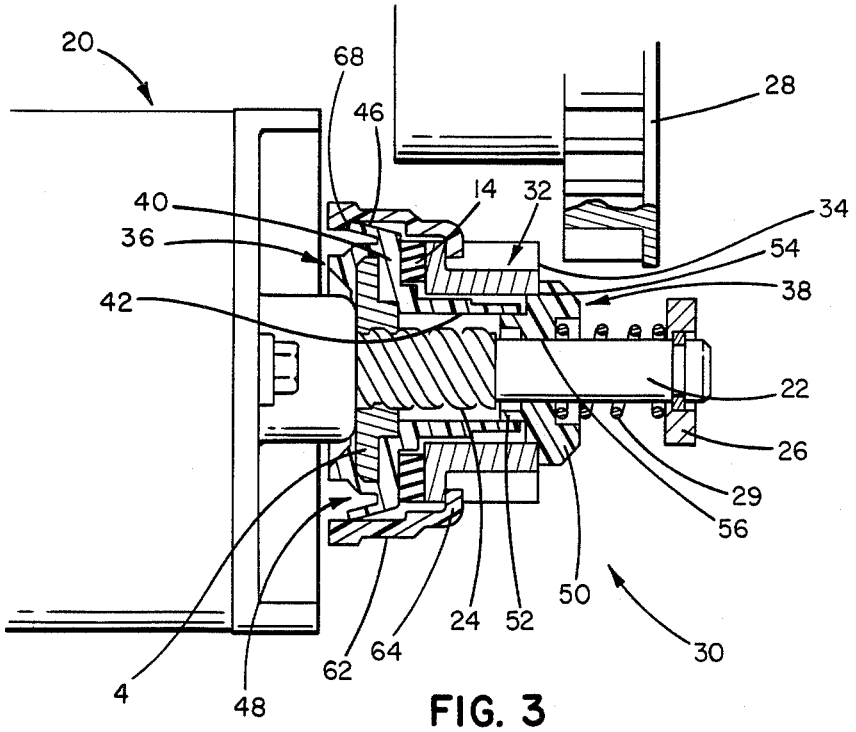
FIG. 3 is a cross-sectional view of a starter motor used for starting the internal combustion engine of a powered implement, particularly illustrating therein the improved pinion assembly of the present invention located on the output shaft of the starter motor.

Referring first to FIGS. 1 and 2, a prior art starter motor pinion assembly is generally illustrated as 2. Pinion assembly 2 is carried on or near the end of the output shaft 22 of an electrical starter motor 20. FIG. 3 illustrates such a starter motor 20 in conjunction with the improved pinion assembly 30 of the present invention, but the prior art pinion assembly 2 is also conventionally carried on output shaft 22 in a manner similar to that depicted for improved pinion assembly 30, as will also be apparent from the following description. Starter motor 20 has been sold either as part of or as an attachment for various snowthrowers manufactured by The Toro Company, the assignee of the present invention. A power cord (not shown) is provided with such snowthrowers to plug starter motor 20 into an electrical outlet (110–120 volts) whenever the operator wants to start the internal combustion engine of the snowthrower. Because the details of starter motor 20 and the products on which it has been used are conventional, they have not been specifically illustrated herein.

Pinion assembly 2 according to the prior art comprises a metallic pinion nut 4 having an internally threaded bore 6. Referring to FIG. 3, output shaft 22 of motor 20 has an externally threaded portion 24 on which nut 4 is threadedly engaged. Threaded portion 24 extends along the axis of shaft 22 for a short distance and has a relatively large pitch, i.e. there is a relatively large distance between adjacent threads. Obviously, the pitched threads on nut 4 and shaft 22 are shaped to mate with one another. In addition, a washer or abutment 26 is fixed to the very end of shaft 22 for a purpose to be described hereafter.

Returning now to FIGS. 1 and 2, pinion assembly 2 also includes a drive pinion 8 made from a plastic material having a plurality of externally protruding gear teeth 10. Drive pinion 8 includes a bore 12 through output shaft 22 is loosely received. An annular rubber disk 14 is sandwiched between pinion nut 4 and an internal annular face 15 on drive pinion 8. Rubber disk 14 is sandwiched between pinion nut 4 and drive pinion 8 to act as a conventional slip clutch. Drive pinion 8 also includes a cylindrical shell 16 which extends axially relative to output shaft 22 and encloses pinion nut 4. That portion of shell 16 which extends past pinion nut 4 is provided with three circumferentially spaced slots 17. A triangularly shaped spring 18 having two outwardly biased legs 19 is located so that the apex point between the legs and the feet of the legs are received in slots 17. See FIG. 2. Spring 18 bears against pinion nut 4 and retains the components of pinion assembly 2 in an assembled relationship.

In the operation of prior art pinion assembly 2, assembly 2 was retained on output shaft 22 by threading pinion nut 4 onto the threaded portion 24 thereof. When the operator plugged motor 20 into an electrical outlet and energized motor 20 by pushing a starter button, shaft 22 would begin rotating. Pinion nut 4 would then axially travel along threaded portion 24 of shaft 22 to move the entire pinion assembly 2 to a position at which gear teeth 10 on drive pinion 8 came into engagement with the gear teeth of a starter gear 28 on the internal combustion engine. At that point, i.e. after drive pinion 8 had engaged starter gear 28, the continuing rotation of shaft 22 would be transferred from pinion nut 4 through rubber disk 14 to drive pinion 8 to rotate the same and spin starter gear 28. The internal combustion engine would then start if the ignition circuit was also activated. Once the engine starts, its faster rotation "kicks out" drive pinion 8 from engagement with starter gear 28 and returns drive pinion 8 to its initial position where drive pinion 8 was not aligned with starter gear 28. A return spring 29 extending between washer 26 and the end of drive pinion 8 helps return pinion assembly 2 back down threaded portion 24 of shaft 22 to its initial position and also prevents engine vibration from moving drive pinion 8 back into engagement with starter gear 28.

While prior art pinion assembly 2 is effective, it was previously believed to be necessary to make drive pinion 8 including gear teeth 10 from a plastic material if one wished to have a double-insulated starter motor. Thus, should the insulation surrounding the wires inside starter motor 20 break down, the plastic material in drive pinion 8 would cut off any path which the electricity might try to take in passing from the metallic portions of pinion assembly 2 to the starter gear 28. Unfortunately, gear teeth 10 on plastic drive pinions 8 tend to wear out or break quite quickly particularly when they are engaged with a metallic starter gear as is common. Such drive pinions 8 must be replaced which is both time-consuming and expensive.

An improved pinion assembly, generally illustrated as 30, has been developed by Applicants to solve the durability problems posed in the prior art pinion assembly 2. Referring to FIG. 3, pinion assembly 30 includes a metallic pinion nut 4 and rubber clutch disk 14 which are identical to those shown in pinion assembly 2 and are thus referred to by the same numerals. In addition, pinion assembly 30 is located on output shaft 22 similarly to pinion assembly 2, i.e. by threading pinion nut 4 onto threaded portion 24 of shaft 22. The return spring 29 extends between the washer 26 on the end of output shaft 22 and pinion assembly 30. The major difference between pinion assembly 2 and the improved pinion assembly 30 is the use in assembly 30 of a metallic drive pinion 32 having a plurality of outwardly extending gear teeth 34. However, pinion assembly 30 allows starter motor 24 to be double insulated since drive pinion 32 is physically and electrically separated from both output shaft 22 and pinion nut 4 through the use of first and second plastic bushings 36 and 38.

The first plastic bushing 36 is generally L-shaped and includes a radially extending annular flange 40 and an axially extending cylindrical shell 42. Drive pinion 32 is carried on shell 42 by having the shell be telescopically received inside the bore of drive pinion 32. The flanged portion of pinion nut 4 is integrally molded or otherwise secured into the radially extending annular flange 40 so as to be completely encased therein. One side of the annular flange 40 comprises an annular face which is separated from and opposed to one side or face of drive pinion 32. Rubber disk 14 is sandwiched into this gap to be retained between drive pinion 32 and first bushing 36. In addition, the radially outermost portion of bushing 36 includes an annular outwardly extending skirt 46 which is separated from the main body of bushing 36 by a cavity or valley 48. Skirt 46 is constructed sufficiently thin and at an angle so as to have some degree of radially outward spring bias for a purpose to be described hereafter.

The second plastic bushing 38 is also generally L-shaped and includes a radially extending flange 50 and a cylindrical shell 52 extending therefrom. Cylindrical shell 52 of bushing 38 is concentrically received inside the open end of first bushing 36 in a press fit with the end of bushing 36 being abutted against the face of the annular flange 50, though FIG. 3 shows a small gap therebetween for the purpose of clarity. Moreover, second bushing 38 includes a central bore 56 which receives the outer end of output shaft 22 and helps support pinion assembly 30 on shaft 22 without wobbling. In addition, annular flange 50 has a small step or shoulder 54 which supports the end of drive pinion 32 since drive pinion 32 extends slightly outwardly past the end of the cylindrical shell 42 of first bushing 36. However, it is not necessary to this invention for this to occur. i.e. drive pinion 32 could be fully supported on the cylindrical shell of the first plastic bushing.

Finally, pinion assembly 30 includes a means for retaining the elements thereof in an assembled relationship. This retaining means includes a generally cylindrical member 62 having an inwardly turned radial flange 64. Flange 64 abuts against a radial surface on drive pinion 32 and retains drive pinion 32 and rubber disk 14 in an assembled relationship on first bushing 36. Cylindrical member 62 includes a plurality of inwardly directed circumferentially spaced steps or shoulders 68 against which skirt 46 bears. Thus, after rubber disk 14 and drive pinion 32 are assembled on first bushing 36 and the second bushing 38 is press fit therein, construction of the assembly can be completed by simply pushing the retaining member 62 down over the assembled components until the radial flange 64 engages drive pinion 32. As the member 62 passes skirt 46 of first bushing 36, skirt 46 will momentarily be deflected inwardly as the shoulders 68 pass over it, but will then snap outwardly to lock against shoulders 68.

Pinion assembly 30 works in all respects identically to that of pinion assembly 2. In other words, as starter motor 20 is energized, pinion nut 4 travels along threaded portion 26 of shaft 22 until drive pinion 32 becomes engaged with the starter gear 28 on the internal combustion engine. Once the engine has started and actuation of motor 20 is stopped, the faster speed of the engine rotation and return spring 29 will then return pinion assembly 30 to its initial deenergized position shown in solid lines in FIG. 3.

The advantages of improved pinion assembly 30 are apparent. The primary advantage is the use in a double insulated starter motor of a pinion assembly incorporating a metallic drive pinion 32 which has greatly improved durability characteristics compared to the plastic drive pinion 8 in prior art pinion assembly 2. In addition, bushings 36 and 38 have been constructed to provide a very circuitous path for any electrical flow which might attempt to reach drive pinion 32. For example, considering first bushing 36, the flanged portion of metallic pinion nut 4 is totally encased in the interior of the radially extending annular flange 40 of that bushing. In addition, bushing 36 includes annular skirt 46 separated from annular flange 40 by valley 48. The only way for electricity to flow from pinion nut 4 to drive pinion 32 is to attempt to get around the outside of the first bushing 36 including traversing valley 48 and skirt 46. Considering second bushing 38, the cylindrical shells 42 and 52 of the first and second bushings 36 and 38 are overlapped by a small degree when they are press fit together. Thus, there is no clean radial surface for the electricity to flow from output shaft 22 to drive pinion 32. Instead, the electricity has to attempt to get through the overlap between the shells. It has been found that this construction of plastic bushings minimizes the chances for any electrical energy from passing through any metallic portions of pinion assembly 30 and output shaft 22 to drive pinion 32.

Various modifications of this invention will be apparent to those skilled in the art. Accordingly, the scope of this invention is to be limited only by the appended claims.

We claim:

1. An improved pinion assembly suitable for use on electrical starter motors having an axially extending metallic output shaft, which comprises:

(a) a metallic pinion nut threadedly received on a portion of the output shaft for axial movement along the output shaft;

(b) a first plastic bushing fixed to the nut for movement therewith, wherein the bushing comprises:

(i) a cylindrical shell which is positioned around and extends axially along the output shaft; and (ii) an annular flange which extends radially outwardly from the shell a sufficient distance to completely cover the pinion nut;

(c) a metallic drive pinion supported on an outside diameter of the shell to one side of the annular flange so that the drive pinion is separated from the output shaft by the shell and from the nut by the annular flange to electrically insulate the drive pinion from the metallic output shaft and pinion nut;

(d) a rubber clutch ring received between one face of the annular flange and an annular face of the drive pinion to transmit torque therebetween; and (e) means for retaining the drive pinion on the cylindrical shell during operation of the pinion assembly.

2. An improved pinion assembly as recited in claim 1, wherein the annular flange of the first bushing is sufficiently thick so that the pinion nut can be molded into the flange with the radially outermost portion of the nut completely encased in the annular flange.

3. An improved pinion assembly as recited in claim 1, further including a second plastic bushing received around the output shaft and having a central bore for receiving the output shaft in a relatively close fit to further support the pinion assembly on the output shaft.

4. An improved pinion assembly as recited in claim 3, wherein the second bushing includes a cylindrical shell concentrically received inside the cylindrical shell of the first bushing in a press fit.

5. An improved pinion assembly as recited in claim 4, wherein the cylindrical shells of the first and second plastic bushings are overlapped by a small distance to provide a more tortuous path for electricity which might attempt to reach the drive pinion.

6. An improved pinion assembly as recited in claim 1, wherein the annular flange of the first bushing includes an annular skirt which extends radially outwardly away from the flange at a small angle and is separated therefrom by a gap.

7. An improved pinion assembly as recited in claim 6, wherein the retaining means comprises a cylindrical member concentrically received around the first bushing and the drive pinion and having a radially inwardly turned flange which bears against a radial surface on the drive pinion, and further including means on the cylindrical member for cooperating with the skirt on the first bushing to hold the the retaining member in an assembled relationship to the first bushing.

8. An improved pinion assembly as recited in claim 7, wherein the skirt is made sufficiently thin so as to be biased radially outwardly away from the annular flange, and wherein the cooperating means includes at least one shoulder which protrudes radially inwardly from the cylindrical member to a position where the skirt can resiliently engage the shoulder.

* * * * *